United States Patent [19]

Pot

[11] 4,114,901

[45] Sep. 19, 1978

[54] SEAL FOR UNLOADING HATCH OF HOPPER BARGE OR SIMILAR VESSEL

[75] Inventor: Hendrik Pot, Alblasserdam, Netherlands

[73] Assignee: N.V. Industrieele Handelscombinatie Holland, Rotterdam, Netherlands

[21] Appl. No.: 826,182

[22] Filed: Aug. 19, 1977

[30] Foreign Application Priority Data

Sep. 1, 1976 [NL] Netherlands ..... 7609734

[51] Int. Cl.[2] ..... E06B 7/22; E06B 7/18; F16J 15/46

[52] U.S. Cl. ..... 277/34.3; 220/232; 49/477

[58] Field of Search ..... 49/477; 220/232; 277/27, 12, 34, 34.3, 226

[56] References Cited

U.S. PATENT DOCUMENTS

| | | | |
|---|---|---|---|
| 2,360,276 | 10/1944 | Redmond | 49/477 X |
| 3,050,791 | 8/1962 | Trexler | 49/477 X |
| 3,125,872 | 3/1964 | Lutzen | 220/232 X |
| 3,178,779 | 4/1965 | Clark et al. | 277/34 X |
| 3,500,584 | 3/1970 | Clery et al. | 220/232 X |
| 3,642,291 | 2/1972 | Zeffer et al. | 277/34 |
| 3,819,479 | 6/1974 | Jacquelin | 49/477 X |

FOREIGN PATENT DOCUMENTS

| | | | |
|---|---|---|---|
| 1,529,041 | 5/1968 | France | 49/477 |
| 257,688 | 9/1926 | United Kingdom | 277/34.3 |

*Primary Examiner*—Robert S. Ward, Jr.
*Attorney, Agent, or Firm*—Young & Thompson

[57] ABSTRACT

A hopper barge has an unloading opening covered by a slide that moves parallel to the plane of the opening. In the closed position, the slide is sealed by an inflatable seal disposed in a channel that opens toward the slide and that surrounds the opening.

3 Claims, 3 Drawing Figures

SEAL FOR UNLOADING HATCH OF HOPPER BARGE OR SIMILAR VESSEL

The invention relates to a seal for the unloading hatch of a hopper barge or a similar vessel discharging from underneath, consisting of a slide, movable parallel to the plane of the opening from one position, in which the opening is covered, to a second position alongside the hatch, and back, the slide functioning together with an elastic sealing around the opening.

Seals for this purpose are well-known. Slides as compared to hinged or vertically movable conical valves are of advantage as they scarcely alter the draught of the unloading vessel. When during opening and closing the slides move over seal members, usually made of rubber, these will wear. Therefore it is common practice to combine the sliding motion with a vertical motion by forcing the slide against the seal member, using wedges, at the end of the closing motion, and by moving the slide away from the seal member, by withdrawing the wedges, before opening the slide. Well-known as it is, this transverse movement complicates the seal and often makes operation difficult, particularly so when closing.

It is an object of the invention to provide a tight seal which is easy to close and to open and which is practically without wear.

According to the invention this object is achieved by a sealing member made out of an inflatable tube, placed in a channel of rectangular cross-section, open to the slide and situated around the opening, and by a slide movable in one plane only, with a slight tolerance of play in relation to the channel's ledges.

According to the invention the slide thus is no longer movable in a direction perpendicular to its plane; instead the tube, protected when empty by the sidewalls of the channel with its open side downwards, will by inflating be expanded and pressed against the slide, thereby producing the seal as required. It is surprising that this seal practically does not wear.

It is to be remarked that inflatable seals, for instance for doors, in themselves are known. With these, though, conditions are quite different from those with hopper barges.

Usually the unloading opening is rectangular. This means that the inflatable tube must follow a rectangular course. To make such a tube as an endless pipe or hose is difficult and expensive. It is another object of the invention to solve this problem by giving the tube as profile an essentially C-type cross-section, the edges of which are fastened to the inside of the channel bottom by one or more cover plates or strips and by bolting. This kind of profile is easier to shape along the rectangular course and to close at its end, and it is also possible to produce straight pieces, meeting specially made rounded parts of similar profile at the corners, rounded parts and straight pieces being vulcanized together at their ends.

The invention will now be described in detail with reference to the drawings.

Figure 1:
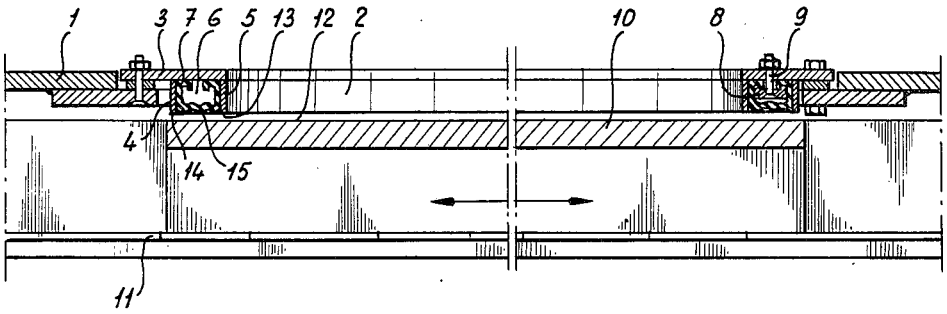
FIG. 1 shows the seal according to the invention in a simplified cross-section.

FIG. 1 shows the bottom 1 of a hopper barge with in it the unloading opening 2, encircled by a frame 3, which together with strips 4 and 5, welded to it, forms a channel 6, open in downward direction, containing a profile 7 of essentially C-type cross-section, which is fastened to the inside of the channel bottom, that is to the frame 3, by coverplate 8 and bolts 9.

The slide, as a whole indicated by 10, is movable along guides 11. In the closed position the slide 10 has, with the surface 12, a slight tolerance of play in relation to the edges 13 and 14 of the channel's sidewalls 4 and 5. When in this position the tube is inflated, the tube will expand outwards, thus with its surface 15 establishing a sealing contact with the slide's surface 12.

Figure 2:
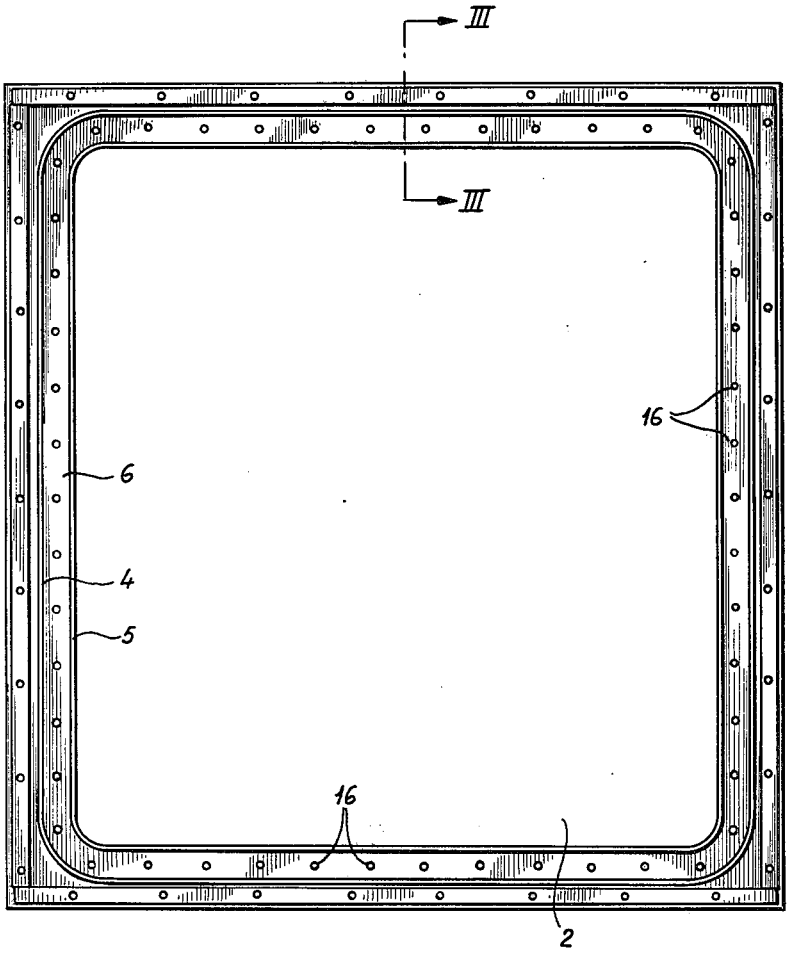
FIG. 2 is a plan view of the unloading hatch, seen from below.

FIG. 2 shows that the channel 6 is rectangular around the hatch 2 and that the channel bottom has a great number of bores 16 to carry the fastening bolts 9, which serve to keep the profile in its place and in sealing contact with the channel bottom 6.

Figure 3:
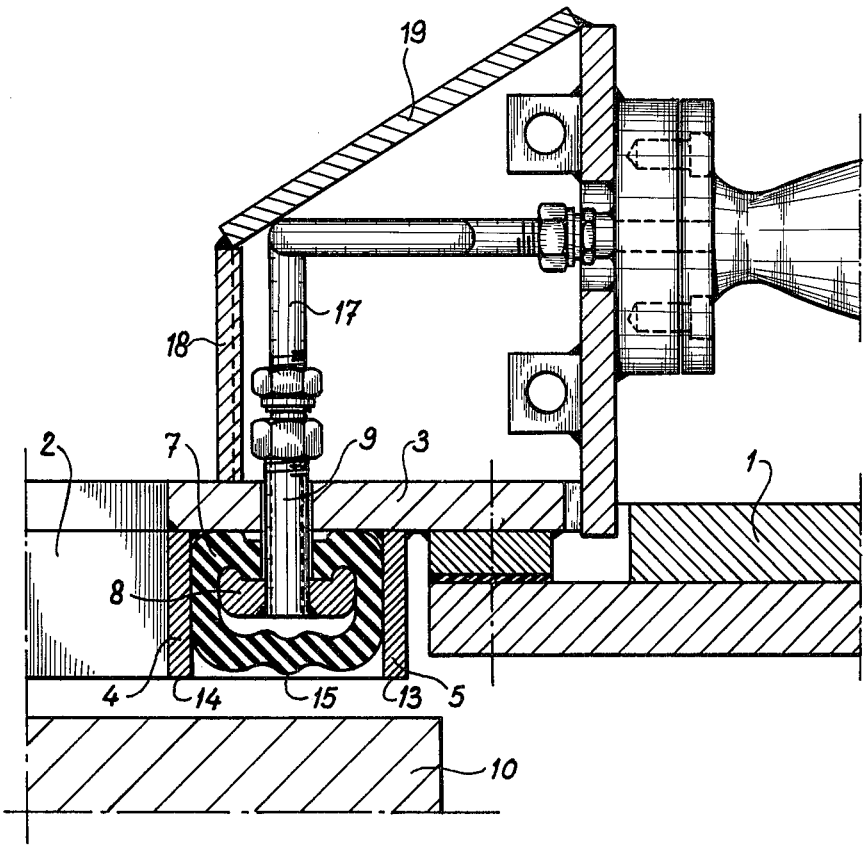
FIG. 3 is a cross-section along the line III—III of FIG. 2 and shows the seal on a larger scale.

FIG. 3 is an enlarged sectional detail and shows the channel, formed by the plates 3, 4 and 5, containing the C-type tube 7, kept in its place by coverplates 8 and bolts 9. The bolt shown in FIG. 3 is bored and communicates through conduit 17 with an adjustable source of compressed air, whereby all seals of all the vessel's slides can be made to engage and to disengage. 18 and 19 are shieldplates facing the hold. It is preferable to have compressed air inlets in several places, so as to engage and disengage the seals quickly.

What I claim is:

1. In a hopper barge having an unloading opening and a slide movable parallel to the plane of the opening to open and close the opening and an elastic seal surrounding the opening to seal against the slide in the closed position of the slide; the improvement in which the sealing member is inflatable, means to inflate the inflatable sealing member, a channel of rectangular cross-section that surrounds said opening and opens toward said slide, and means mounting said slide for sliding movement in one plane only, with the slide spaced a substantially constant distance from said channel.

2. Structure as claimed in claim 1, in which said sealing member has a C-shaped cross-section, the edges of which are secured to the inside of the channel bottom by at least one strip and by bolts.

3. Structure as claimed in claim 2, at least one of said bolts having a bore therethrough, and means to supply fluid under pressure through said bore into said sealing member.

* * * * *